US008248191B2

(12) United States Patent
Li et al.

(10) Patent No.: US 8,248,191 B2
(45) Date of Patent: Aug. 21, 2012

(54) MICROSTRIP FILTER

(75) Inventors: Guang-Ze Li, Shenzhen (CN); Gui-Dong Zhu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 345 days.

(21) Appl. No.: 12/699,248

(22) Filed: Feb. 3, 2010

(65) Prior Publication Data

US 2011/0068883 A1 Mar. 24, 2011

(30) Foreign Application Priority Data

Sep. 18, 2009 (CN) ..... 2009 1 0307324

(51) Int. Cl.
*H01P 1/203* (2006.01)

(52) U.S. Cl. ..... 333/204; 333/185

(58) Field of Classification Search ..... 333/175, 333/185, 204, 134, 128
See application file for complete search history.

(56) References Cited

U.S. PATENT DOCUMENTS

| | | | | |
|---|---|---|---|---|
| 6,614,329 | B1 * | 9/2003 | Woods et al. | 333/204 |
| 6,624,728 | B2 * | 9/2003 | Miyazaki et al. | 333/204 |
| 6,927,648 | B2 * | 8/2005 | Furuya et al. | 333/132 |
| 7,142,836 | B2 * | 11/2006 | Yang | 455/307 |
| 7,944,328 | B2 * | 5/2011 | Wu | 333/185 |
| 8,049,578 | B1 * | 11/2011 | Albers et al. | 333/134 |
| 2007/0216498 | A1 * | 9/2007 | Chen | 333/204 |

FOREIGN PATENT DOCUMENTS

TW 200524488 A 7/2005

* cited by examiner

*Primary Examiner* — Seungsook Ham
(74) *Attorney, Agent, or Firm* — Altis Law Group, Inc.

(57) ABSTRACT

A filter includes a circuit board, a low-pass filter circuit, and a high-pass filter circuit. The circuit board includes at least one metal layer, and a dielectric layer attached on the at least one metal layer. The low-pass filter circuit is defined in the metal layer, and includes a main line that has two parallel portions, and a modulating circuit serving as a capacitor connected to the main line of the low-pass filter circuit. The high-pass filter circuit defined in the metal layer includes a main line that has two parallel portions and is connected to the low-pass filter circuit, and a modulating circuit serving as a conductor connected to the main line of the high-pass filter circuit.

15 Claims, 3 Drawing Sheets

MICROSTRIP FILTER

BACKGROUND

1. Technical Field

The disclosure relates to filters, and more particularly, to a microstrip filter.

2. Description of Related Art

Vast information interchange occurs via wireless communications systems. During transmission, information may be carried by microwave signals. To achieve successful long distance transmission, high-powered transmitters are used which can result in electromagnetic interference (EMI) in devices such as cellular phones or radio receivers. EMI may interrupt, obstruct, or otherwise degrade or limit the effective performance of the devices. As a result, various microstrip filters have been developed and adopted in the devices as EMI shields. However, a typical microstrip filter consists of discrete elements such as, resistors, capacitors, and inductors, which makes the filter bulky, costly, and environmentally hazardous.

What is needed is a microstrip filter addressing the aforedescribed problems.

DETAILED DESCRIPTION

Figure 1:
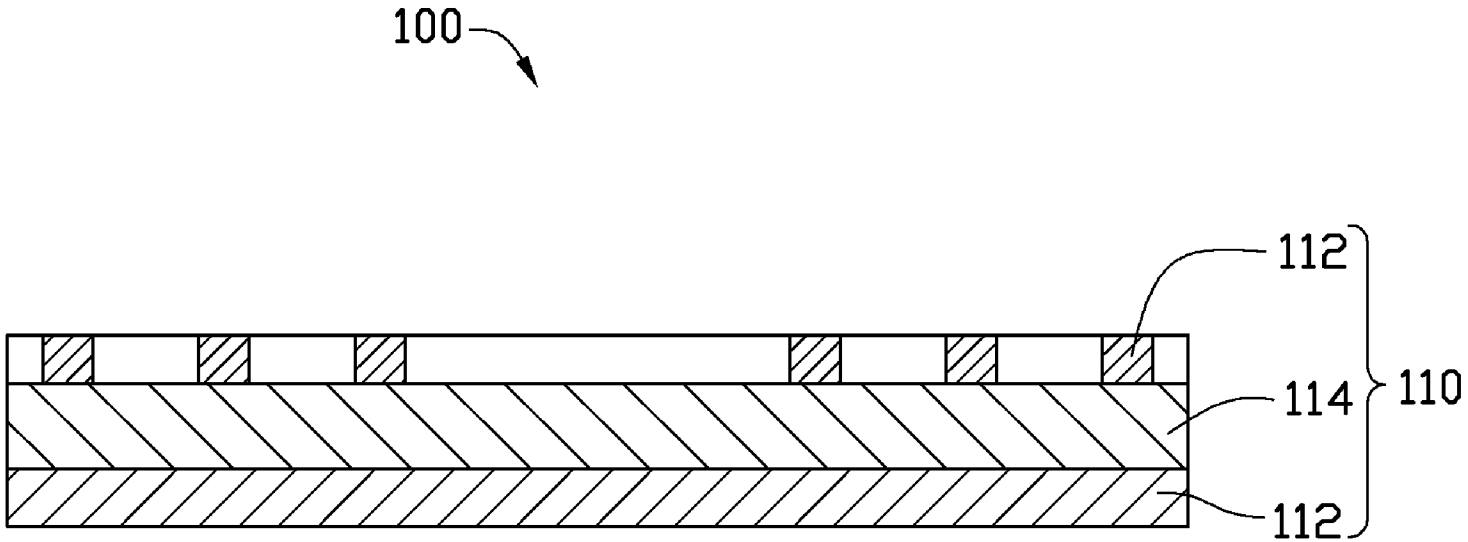
FIG. 1 is a cross-sectional view of a microstrip filter according to a first exemplary embodiment.
Figure 2:
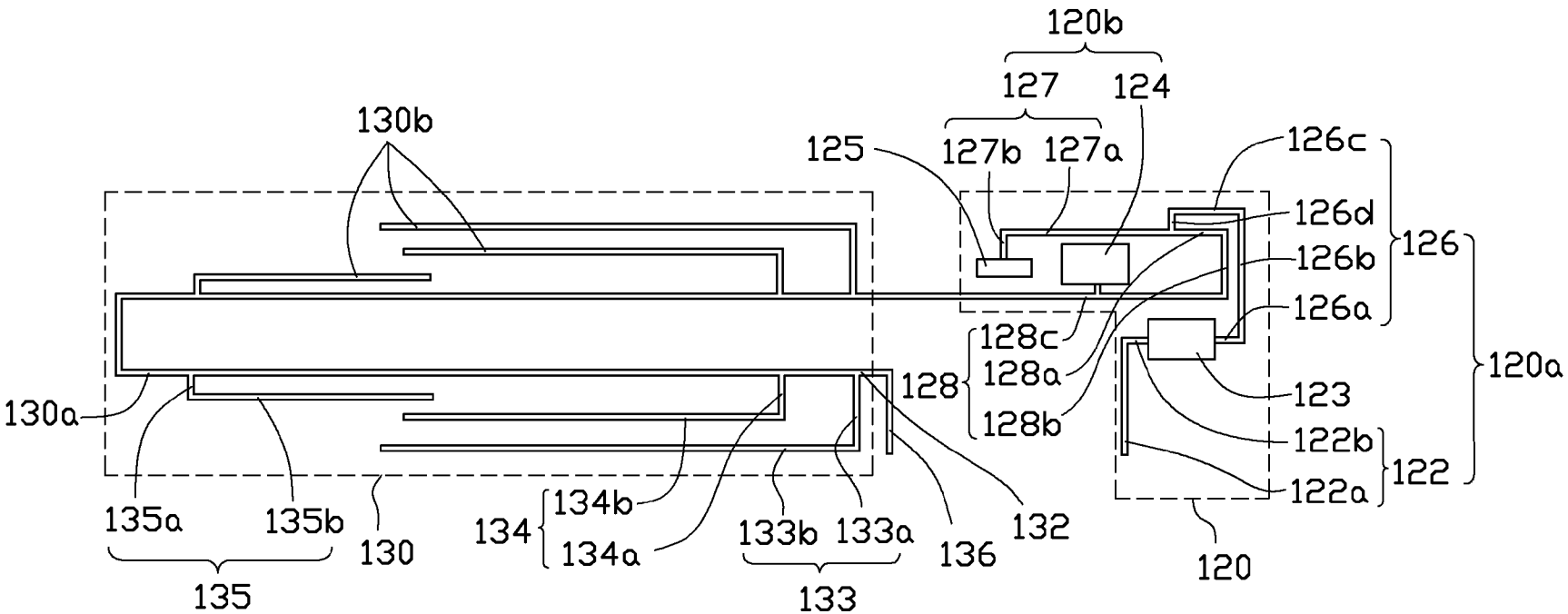
FIG. 2 is top view of a pattern of the microstrip filter of FIG. 1.

Referring to FIGS. 1 and 2, a microstrip filter 100 of an exemplary embodiment is shown. The microstrip filter 100 includes a circuit board 110, a low-pass filter circuit 120, and a high-pass filter circuit 130. The low-pass filter circuit 120 and the high-pass filter circuit 130 are formed in the circuit board 110 in series interconnection with each other.

The circuit board 110 includes two metal layers 112, and a dielectric layer 114 below one of the metal layers 112 and above the other one. In one exemplary embodiment, two metal layers 112 are isolated from each other by the dielectric layer 114. The low-pass filter circuit 120 and the high-pass filter circuit 130 are formed on the metal layers 112 by means of chemical etching, physical etching, or copperplating methods. The low-pass filter circuit 120 and the circuit board 110 cooperatively construct a low-pass filter (not shown). The high-pass filter circuit 130 and the circuit board 110 cooperatively construct a high-pass filter. Either one or both of the filters may be employed in a same device.

Referring to FIG. 2, the low-pass filter circuit 120 and the high-pass filter circuit 130 both include a main line respectively indicated as 120*a*, 130*a*. The linked main lines 120*a* and 130*a*, each has two approximately parallel portions to reduce the length of the corresponding lines 120*a* and 130*a*. The low-pass filter circuit 120 further includes a modulating circuit 120*b* composed of wide and short low impedance portions connected respectively with the main line 120*a* in parallel or series, which serve as capacitors. The high-pass filter circuit 130 further includes a modulating circuit 130*b* composed of a number of perpendicularly bent branches that extend from the main line 130*a*, and that are simultaneously parallel to the longer portion of the main lines 130*a*. The branches of the modulating circuit 130*b* serve as conductors.

The main line 120*a* of the low-pass filter circuit 120 includes an input portion 122, a transmission portion 126, and an output portion 128. The modulating circuit 120*b* includes a first low impedance portion 123, a second low impedance portion 124, a third low impedance portion 125, and an extending portion 127. The input portion 122 is connected to the transmission portion 126 via the first low impedance portion 123. The transmission portion 126 is successively connected to the extending portion 127. The output portion 128 is successively connected to the transmission portion 126 and the extending portion 127. The second low impedance portion 124 and the third low impedance portion 125 are correspondingly connected to the extending portion 127 and the output portion 128 through two branching portions that correspondingly perpendicularly extend from the extending portion 127 and the output portion 128.

The input portion 122 includes a first vertical segment 122*a* and a first horizontal segment 122*b*. The first horizontal segment 122*b* perpendicularly extends from a terminal end of the vertical segment 122*a* to the first low impedance portion 123. The first horizontal segment 122*b* is shorter than the first vertical segment 122*a* in length.

The transmission portion 126 includes a second horizontal segment 126*a*, a second vertical segment 126*b*, a third horizontal segment 126*c*, and a third vertical segment 126*d*. The second horizontal segment 126*a* is connected between the first low impedance portion 123 and the second vertical segment 126*b*. The second vertical segment 126*b* perpendicularly extends from an end of the second horizontal segment 126*a*. The second vertical segment 126*b* of the transmission portion 126 is parallel to the first vertical segment 122*a* of the input portion 122 but extends along the vertical direction away from the first vertical segment 122*a*. In one exemplary embodiment, a total length of the first vertical segment 122*a* and the second vertical segment 126*b* is about 18 mm. The third horizontal segment 126*c* perpendicularly extends from the terminal end of the second vertical segment 126*b*. The third horizontal segment 126*c* is parallel to the second horizontal segment 126*a* and extends horizontally towards the first low impedance portions 123. The third vertical segment 126*d* perpendicularly extends from the terminal end of the third horizontal segment 126*c* towards the first low impedance portion 123. Exemplarily, the third horizontal segment 126*c* is longer than the second horizontal segment 126*a*.

The extending portion 127 includes an extending segment 127*a* and a bent segment 127*b*. The extending segment 127*a* perpendicularly extends from the terminal end of the third vertical segment 126*d* of the transmission portion 126, and horizontally extends away from the second vertical segment 126*c* of the transmission portion 126. The bent segment 127*b* perpendicularly extends from the terminal end of the extending segment 127*a*, along a direction away from the third horizontal segment 126*c*. The length of the extending segment 127*a* is longer than that of the bent segment 127*b*.

The output portion 128 includes a fourth horizontal segment 128*a*, a fourth vertical segment 128*b* and a fifth horizontal segment 128*c*. The fourth horizontal segment 128*a* perpendicularly extends from the terminal end of the third vertical segment 126*d* of the transmission portion 126 towards the second vertical segment 126*b* of the transmission portion 126. The length of the fourth horizontal segment 128*a* is shorter than that of the third horizontal segment 126*c* of the transmission portion 126. The fourth vertical segment 128*b* perpendicularly extends from the terminal end of the fourth horizontal segment 128*a* towards the second horizontal segment 126*a* of the transmission portion 126. The fourth vertical segment 128*b* is longer than the bent segment 127*b* of the extending portion 127. The fifth horizontal segment 128*c* perpendicularly extends from the terminal end of the fourth vertical segment 128*b* along a direction away from the second vertical segment 126*b* of the transmission portion 126. The terminal end of the fifth horizontal segment 128*c* extends beyond the terminal end of the bent segment 127*b* of the extending portion 127.

The second low impedance portion 124 is positioned between the extending segment 127*a* of the extending portion 127 and the fifth horizontal segment 128*c* of the output portion 128, and connected to the fifth horizontal segment 128*c* via a branch perpendicularly extended from the middle of the fifth horizontal segment 128*c*. The third low impedance portion 125 is connected to the terminal end of the bent segment 127*b* of the extending portion 127.

In the low-pass filter circuit 120, sections of the main line 120*a* may be bent to reduce the size of the low-pass filter circuit 120. The modulating circuit 120*b* serves as capacitors for filtering high frequency signals.

The main line 130*a* of the high-pass filter circuit 130 includes a main portion 132 and a terminal portion 136. The modulating circuit 130*b* of the high-pass filter circuit 130 includes a pair of first coupled lines 133, a pair of second coupled lines 134, and a pair of third coupled lines 135. The main portion 132 is connected to the terminal end of the fifth horizontal segment 128*c* of the output portion 128, and portion of the main portion 132 is collinear (not shown) to the fifth horizontal segment 128*c*. The parallel branches of the main portion 132 comprise a "U" shaped microstrip facing the low-pass filter circuit 130 which significantly saves space.

The terminal portion 136 is perpendicularly connected to the terminal end of the main portion 132 and parallel to the first vertical segment 122*a* of the input portion 122.

The first coupled lines 133 symmetrically extend from the two parallel segments of the main portion 132. Each of the first coupled line 133 includes a first connecting segment 133*a* and a first bent segment 133*b*. The first connecting segment 133*a* of each first coupled line 133 perpendicularly extends from the main portion 132 adjacent to the opening of the U-shaped main portion 132. The first bent segment 133*b* of each first coupled line 133 extends from the terminal end of the first connecting segment 133*a* towards the closed end of the U-shaped main portion 132. The first bent segments 133*b* of the first coupled line 133 are parallel to the parallel portions of the main portion 132.

The second coupled line 134 symmetrically extend from the two parallel portions of the main portion 132, adjacent and parallel to the corresponding first coupled line 133. Each of the second coupled line 134 includes a second connecting segment 134*a* and a second bent segment 134*b*. The second connecting segment 134*a* of each second coupled line 134 perpendicularly extends from the main portion 132, adjacent to the first connecting segment 133*a* of the first coupled line 133. The length of the second connecting segment 134*a* of the second coupled line 134 is shorter than that of the first connecting segment 133*a* of the first coupled line 133. The second bent segment 134*b* of each second coupled line 134 perpendicularly extends from the terminal end of the connecting segment 134*a* of the second coupled line 134 towards the closed end of the U-shaped microstrip 132. The second bent segments 134*b* of the second coupled line 134 are parallel to the parallel portions of the main portion 132. The length of the second bent segment 134*b* of the second coupled line 134 is shorter than that of the first bent segment 133*b* of the first coupled line 133.

The third coupled line 135 symmetrically extend from the two parallel portions of the main portion 132, adjacent to the closed end of the U-shaped main portion 132. Each of the third coupled line 135 includes a third connecting segment 135*a* and third bent segment 135*b*. The third connecting segment 135*a* of each third coupled line 135 perpendicularly extends from the main portion 132. The length of the third connecting segment 135*a* of the third coupled line 135 is shorter than that of the second connecting segment 134*a* of the second coupled line 134. The third bent segment 135*b* of each third coupled line 135 perpendicularly extends from the terminal end of the third connecting segment 135*a*, towards the opening of the main portion 132. The third bent segments 135*b* of the third coupled line 135 are parallel to the parallel portions of the main portion 132. The distance between the second connecting segment 134*a* of the second coupled line 134 and the third bent segment 135*b* of the third coupled line 135, is about two times the length of the third bent segment 135*b* of the third coupled line 135.

The first, second and third coupled lines 133, 134, 135 serve as conductors to filter low frequency signals.

Figure 3:
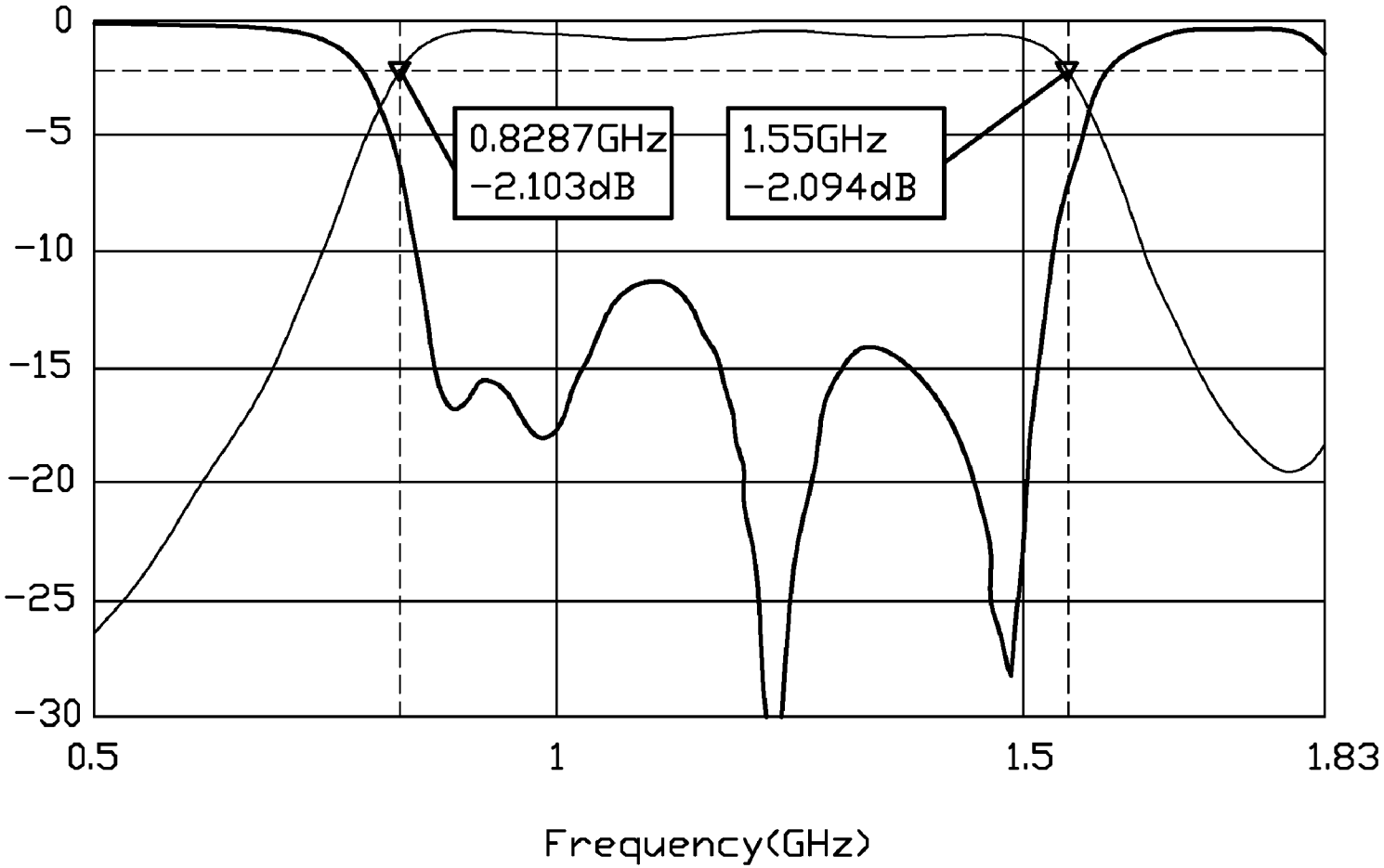
FIG. 3 is a graph of a computer simulated frequency response of the microstrip filter of FIG. 2.

Referring to FIG. 3, a computer simulated frequency response of the microstrip filter 100 is shown. Waves whose frequencies fall within 0.8 GHZ~1.55 GHG pass the microstrip filter 100 low insertion loss. However, waves whose frequencies fall beyond 0.8 GHZ~1.55 GHG are well filtered.

The microstrip filter 100 is composed of interconnecting the low-pass filter circuit 120 and the high-pass filter circuit 130, in series. The low-pass filter circuit 120 and the high-pass filter circuit 130 are designed small in size by parallely configuring the main lines thereof. The modulating circuit 120*a*, 130*a* are connected respectively to the main line 120*a*/130*a* in series or parallel, thereby forming capacitors and conductors to reduce, or even, eliminate EMI. The microstrip filter 100 is compact, cost-efficient, and environmentally friendly. Accordingly, the low-pass filter circuit 120 and high-pass filter circuit 130 can each be used independently, without prejudice to the present embodiment.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A low-pass filter, comprising:

a circuit board comprising at least one metal layer, and a dielectric layer positioned below the at least one metal layer; and a low-pass filter circuit defined in the metal layer, the low-pass filter circuit comprising a main line that has two parallel portions, and a modulating circuit serving as a capacitor connected to the main line;

wherein the main line of the low-pass filter circuit comprises an input portion, a transmission portion and an output portion which are successively connected in series; the modulating circuit includes a first low impedance portion, a second low impedance portion, a third low impedance portion, and an extending portion that is connected to an end of the transmission portion; the first low impedance portion interconnects the input portion and the transmission portion; the second low impedance portion and the third low impedance portion are connected respectively to the extending portion and the output portion through two branching portions that respectively perpendicularly extend from the extending portion and the output portion;

wherein the input portion comprises a first vertical segment and a first horizontal segment; the first horizontal segment perpendicularly extends from a terminal end of the vertical segment to the first low impedance portion; the first horizontal segment is shorter than the first vertical segment in length.

2. The low-pass filter of claim 1, wherein the transmission portion comprises a second horizontal segment, a second vertical segment, a third horizontal segment, and a third vertical segment; the second horizontal segment is connected between the first low impedance portion and the second vertical segment; the second vertical segment is parallel to the first vertical segment but extends along the vertical direction away from the first vertical segment; the third horizontal segment perpendicularly extends from the terminal end of the second vertical segment; the third horizontal segment is parallel to the second horizontal segment and extends along the horizontal direction towards the first low impedance portions; the third vertical segment perpendicularly extends from the terminal end of the third horizontal segment towards the first low impedance portion.

3. The low-pass filter of claim 2, wherein the third horizontal segment is longer than the second horizontal segment.

4. The low-pass filter of claim 3, wherein a sum length of the first vertical segment of the input portion and the second vertical segment of the transmission portion is about 18 mm.

5. The low-pass filter of claim 2, wherein the extending portion comprises a extending segment and a bent segment, the extending segment perpendicularly extends from the terminal end of the third vertical segment of the transmission portion, and horizontally extends away from the second vertical segment of the transmission portion, the bent segment perpendicularly extends from the terminal end of the extending segment and extends along a direction away from the third horizontal segment.

6. The low-pass filter of claim 5, wherein the length of the extending segment is longer than that of the bent segment.

7. The low-pass filter of claim 5, wherein the output portion comprises, a fourth horizontal segment, a fourth vertical segment and a fifth horizontal segment, the fourth horizontal segment perpendicularly extends from the terminal end of the third vertical segment of the transmission portion towards the second vertical segment of the transmission portion; the fourth vertical segment perpendicularly extends from the terminal end of the fourth horizontal segment towards the second horizontal segment of the transmission portion; the fifth horizontal segment perpendicularly extends from terminal end of the fourth vertical segment along a direction away from the second vertical segment of the transmission portion; the terminal end of the fifth horizontal segment extends beyond the terminal end of the extending portion.

8. The low-pass filter of claim 7, wherein the length of the fourth horizontal segment is shorter than that of the third horizontal segment of the transmission portion; the length of the fourth vertical segment is longer than that of the bent segment of the extending portion.

9. A high-pass filter, comprising:

a circuit board comprising at least one metal layer, and a dielectric layer positioned below the at least one metal layer; and a high-pass filter circuit defined in the metal layer, and comprising a main line that has two parallel portions, and a modulating circuit serving as an conductor connected to the main line;

wherein the main line of the high-pass filter circuit comprises a main portion and a terminal portion; the modulating circuit of the high-pass filter circuit comprises a pair of first coupled lines, a pair of second coupled lines, a pair of third coupled lines; the main portion is perpendicularly bent twice to form a rectangular "U" shape; the terminal portion is perpendicularly connected to the terminal end of the main portion; each pair of the first, second and third coupled lines are parallel with each other and are symmetrically connected to the two parallel portions of the main portion.

10. The high-pass filter of claim 9, wherein the first coupled lines are symmetrically connected to the two parallel portions of the main portion, each of the first coupled line comprises a first connecting segment and first bent segment, the first connecting segment of each of the first coupled lines perpendicularly extends from the main portion adjacent to the opening of the main portion, the first bent segment of each first coupled line extends from the terminal end of the first connecting segment towards a closed end of the main portion, the first bent segments of the first coupled lines are parallel to the parallel portions of the main portion.

11. The high-pass filter of claim 10, wherein the second coupled lines are symmetrically connected to the two parallel portions of the main portion adjacent and parallel to the corresponding first coupled lines, each of the second coupled lines comprises a second connecting segment and second bent segment, the second connecting segment of each second coupled line perpendicularly extends from the main portion adjacent to the first connecting segment of the first coupled line, the second bent segment of each second coupled line extends from the terminal end of the second connecting segment towards the closed end of the main portion; the second bent segments of the second coupled lines are parallel to the parallel portions of the main portion.

12. The high-pass filter of claim 11, wherein the length of the second connecting segment of the second coupled line is shorter than that of the first connecting segment of the first coupled line.

13. The high-pass filter of claim 11, wherein the third coupled lines are symmetrically connected to the two parallel portions of the main portion adjacent to the closed end of the main portion, each of the third coupled lines includes a third connecting segment and third bent segment, the third connecting segment of each third coupled line perpendicularly extends from the main portion; the third bent segment of each third coupled line perpendicularly extends from the terminal end of the third connecting segment towards the opening of the main portion; the third bent segments of the third coupled lines are parallel to the parallel portions of the main portion.

14. The high-pass filter of claim 13, wherein the length of the third connecting segment of the third coupled line is shorter than that of the second connecting segment of the second coupled line; the distance between the second connecting segment of the second coupled line and the third bent segment of the third coupled line is about two times the length of the third bent segment of the third coupled line.

15. A filter, comprising:

a circuit board comprising at least one metal layer, and a dielectric layer positioned below the at least one metal layer;

a low-pass filter circuit defined in the metal layer, the low-pass filter circuit comprising a main line that has two parallel portions, and a modulating circuit serving as a capacitor connected to the main line of the low-pass filter circuit; and a high-pass filter circuit defined in the metal layer, and comprising a main line that is connected to the main line of the low-pass filter circuit and has two parallel portions, and a modulating circuit serving as an conductor connected to the main line of the high-pass filter circuit;

wherein the main line of the high-pass filter circuit comprises a main portion and a terminal portion; the modulating circuit of the high-pass filter circuit comprises a pair of first coupled lines, a pair of second coupled lines, a pair of third coupled lines; the main portion is perpendicularly bent twice to form a rectangular "U" shape; the terminal portion is perpendicularly connected to the terminal end of the main portion; each pair of the first, second and third coupled lines are parallel with each other and are symmetrically connected to the two parallel portions of the main portion.

* * * * *